United States Patent [19]

Elliot

[11] 4,062,768

[45] Dec. 13, 1977

[54] SIEVING OF MATERIALS

[75] Inventor: Jack Elliot, Leeds, England

[73] Assignee: Locker Industries Limited, Great Britain

[21] Appl. No.: 607,942

[22] Filed: Aug. 26, 1975

Related U.S. Application Data

[63] Continuation-in-part of Ser. No. 413,767, Nov. 8, 1973, abandoned.

[30] Foreign Application Priority Data

Nov. 14, 1972 United Kingdom ..... 52562/72

[51] Int. Cl.[2] ..... B07B 1/30

[52] U.S. Cl. ..... 209/341; 209/1; 209/365 A; 210/19

[58] Field of Search ..... 209/1, 237, 325, 329, 209/365 R, 365 A, 365 B, 368, 310, 341; 210/19, 388, 389; 259/1 R, 72, DIG. 41, DIG. 42, DIG. 44; 198/220 A, 220 CA, 220 DB, 220 DC, 766, 769

[56] References Cited

U.S. PATENT DOCUMENTS

| | | | |
|---|---|---|---|
| 1,459,838 | 6/1923 | Mitchell | 209/341 |
| 2,831,576 | 4/1958 | Wehner | 209/365 B |
| 3,070,230 | 12/1962 | Peterson | 209/310 |
| 3,173,664 | 3/1965 | Isaacson | 259/1 R X |
| 3,251,457 | 5/1966 | Dumbaugh | 198/220 DB |
| 3,330,411 | 7/1967 | Evlenstadt | 209/368 X |
| 3,438,490 | 4/1969 | Peterson | 209/269 |
| 3,468,418 | 9/1969 | Renner | 198/220 A X |
| 3,490,584 | 11/1970 | Balamuth | 209/1 |
| 3,706,372 | 12/1972 | Mubschoot | 198/220 CA |
| 3,864,249 | 2/1975 | Wallis | 209/1 X |

FOREIGN PATENT DOCUMENTS

| | | | |
|---|---|---|---|
| 1,041,332 | 10/1959 | Germany | 209/329 |
| 1,094,218 | 12/1967 | United Kingdom | 209/1 |

*Primary Examiner*—Robert Halper
*Attorney, Agent, or Firm*—Stevens, Davis, Miller & Mosher

[57] ABSTRACT

Sieving apparatus comprising a sieve carrier, means for imparting longitudinal vibratory movement to the sieve carrier said movement having substantially no vertical component, a sieving medium, a sieve frame to which said sieving medium is secured and supporting said sieving medium at an inclination of not more than 5° to the horizontal, resilient means interposed between the sieve frame and the sieve carrier to support said sieve frame in said sieve carrier, an ultrasonic generator mounted on said sieve carrier and separate from said means for imparting vibratory motion, and coupling means coupling the output from said ultrasonic generator to said sieve frame, in a direction substantially parallel to the plane of the sieving medium.

9 Claims, 4 Drawing Figures

-FIG. 2-

SIEVING OF MATERIALS

This application is a continuation-in-part of Application Ser. No. 413,767 now abandoned dated Nov. 8th, 1973.

This invention relates to a sieving of materials.

It is well known that there is no great problem in the sieving of materials to separate particles which will pass through a 100 mesh (British Standard size) sieve or larger, i.e., particles larger than 150 microns. Difficulties are, however, experienced when working to separate finer particles. Fine materials, such as talc, flour, milk powder and cocoa, tend to coat the sieve medium, and also tend to become airborne due to movement transmitted from the sieve. As a result of these factors, the separation of fine materials using oscillating or vibratory sieves is a very unsatisfactoryan inefficient operation.

Some separation of fine powders is carried out using rotary sieves relying on centrifugal force to throw the powder through a cylindrical sieve, but even this is inefficient due to coating and clogging of the sieve medium by the fine particles. The most efficient method of sieving fine materials at present in use is by use of the so-called "cutting tower" wherein the material to be sieved is entranced in an air flow and blown through a cyclone system. From the cyclone system the fine particles required take one path and the coarser particles take a different path. The air flow carrying the fine particles is then filtered to recover the required particles. This system is cumbersome and costly.

In accordance with the present invention sieving apparatus comprises a sieve carrier, means for imparting longitudinal vibratory movement to the sieve carrier said movement having substantially no vertical component, a sieving medium, a sieve frame to which said sieving medium is secured and supporting said sieving medium at an inclination of not more than 5° to the horizontal, resilient means interposed between the sieve frame and the sieve carrier to support said sieve frame in said sieve carrier, an ultransonic generator mounted on said sieve carrier separate from said means for imparting vibratory motion, and coupling means coupling the output from said ultrasonic generator to said sieve frame, in a direction substantially parallel to the plane of the sieving medium.

The invention provides novel arrangement of elements of a sieving apparatus which enables even finely powdered and sticky materials to be sieved efficiently. By inclining the sieving medium at no more than 5° to the horizontal, by imparting the longitudinal vibratory movement so that it has substantially no vertical component and by applying the output from the ultrasonic generator in a direction substantially parallel to the plane of the sieving medium the movement of the sieving medium is such that it all takes place substantially in the plane of the sieving medium. As there is a negligible component of movement transverse to the plane of the sieving medium the particles are not thrown into the air from the sieving medium but remain in contact with the medium during the whole of the sieving process. The inclination of the sieving medium at no more than 5° to the horizontal is also important as the efficient area of each individual hole in the sieving medium becomes smaller as the angle to the horizontal increases. The effective area is the vertical projection of the hole on to a horizontal plane and obviously this area is at its maximum when the sieving medium is truly horizontal and decreased as the inclination to the horizontal is increased. The ultrasonic vibrations applied to the sieve frame have the effect of constantly cleaning the sieving medium so that particles of material can not build up on this medium and so block the openings. Thus, "blinding", the slipping of materials over openings in the sieving medium screened by other particles, is avoided. The resilient means between the sieve frame and the sieve carrier restrict the ultrasonic vibration to the actual sieve frame and sieving medium. If ultrasonic vibrations are applied to a large mass of material they are effectively damped so that their effect can become unnoticable. By restricting the vibrations to the sieve frame and sieving medium, and preventing their transmission into the sieve carrier the vibrations are restricted to the required region. The resilient means is also of advantage as ultrasonic vibrations transmitted across the seiving medium will be reflected by the resilient means back across the sieving medium so causing harmonics of the base vibration to occur and increasing the efficiency.

This concept of restricting all movement substantially to the plane of the sieving medium and of isolating ultrasonic vibrations to be effective on the sieve frame and sieving medium only gives the apparatus of the invention unique advantages and allows very fine materials to be sieved with a degree of efficiency not hitherto achieved using a sieving medium.

Preferably the means for imparting vibratory motion to the sieve carrier is a vibrator motor comprising a shaft having an out-of-balance weight and coupled to the sieve carrier by way of a pendulum base. As the shaft of the motor rotates the out-of-balance weight induces vibrations in the motor in two perpendicular planes, and the pendulum base absorbs the vibrations in one plane so transmitting vibrations in a single plane to the sieve carrier. The arrangement of the mounting is obviously such that the plane of these vibrations is substantially parallel to the plane of the sieving medium.

Other types of vibrator motors which will produce vibration in a single plane only can alternatively be used. One such example is a unit comprising two vibrator motors wired to rotate in opposite direction at the same speed. The axes of the two motors are in the same plane and each motor has a shaft carrying an out-of-balance weight, the weight on one shaft being displaced by 180° from the weight on the other shaft. Operation of this unit will produce a linear vibratory motion at right angles to the motor axes.

Preferably the sieve frame is wholly supported on the sieve carrier by the resilient means and desirably these means are strips of resilient material interposed between the sieve frame and the sieve carrier.

More than one ultrasonic generator may be mounted on the sieve member, the number and location of generators depending mainly on the size of sieve. For a small sieve a single generator may suffice. Wide sieves may require generators at each side thereof, and long sieves may require generators spaced at intervals along the length thereof. The required number of generators for a particular sieve, and their location, can easily be found by trial and error.

Any conventional ultrasonic generator can be used and desirably the output member of the generator is coupled directly to the sieve frame. It is desirable that the coupling of the generator to the frame be as rigid as possible in order to minimise power losses on the coupling.

Preferably the ultrasonic generator is tunable. The frequency of the ultrasonic vibration is not critical but for any given set of parameters of the material, sieving medium and feed rate of material onto the sieve there is an optimum amplitude range of the ultrasonic vibration for most effective operation. It is at present thought that this amplitude can not be derived mathematically due to the large number of factors to be taken into account. However, by utilising a tunable ultrasonic generator to drive the sieving medium the generator may readily be set to the optimum condition for any particular sieving operation merely by visual observation of the material. Thus, the generator need only be adjusted until it can be seen that there is a smooth, even progression of material over the seiving medium, without a build-up of material at any part of the seiving medium.

Conversely, the method may be performed with an ultrasonic generator operating at a fixed frequency and amplitude, compensation for different material parameters and sieving medium characteristics being effected by adjusting the feed rate of material on to the sieve.

Generally speaking it is found that either the ultrasonic amplitude must be increased or the material feed rate decreased if, for example, (a) seiving of smaller particle size material through smaller mesh sieving media is desired; (b) sieving of stickier materials — due to material fineness, moisture content or other factor — is desired; (c) there is an increase in the ambient humidity when using a cloth sieving medium, since the cloth becomes slacker in more humid conditions.

A specific embodiment of sieving apparatus according to the invention will not be described in more detail by way of example only, with reference to the accompanying drawings, in which.

Figure 1:
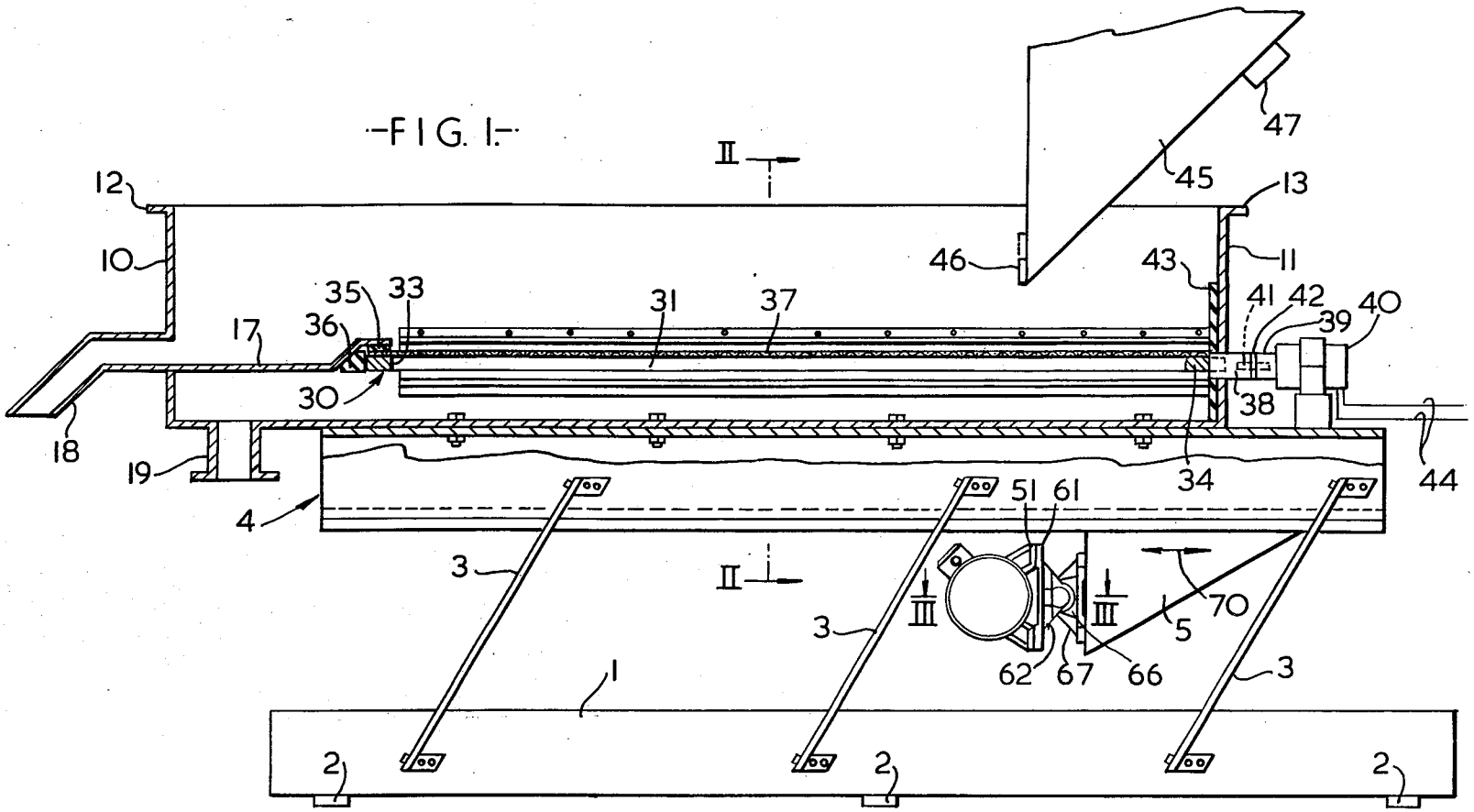
FIG. 1 is a schematic part side elevation part longitudinal cross-section of the apparatus.
Figure 2:
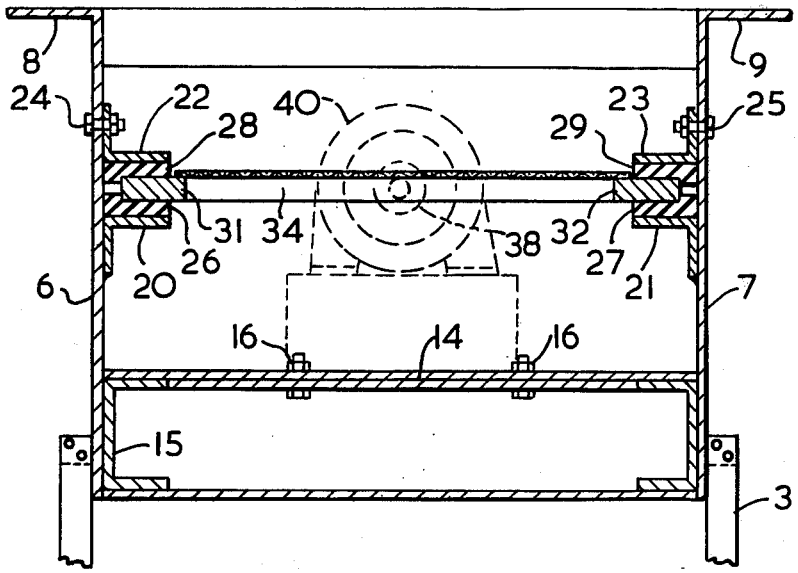
FIG. 2 is a cross-section on the line II-II of FIG. 1.
Figure 3:
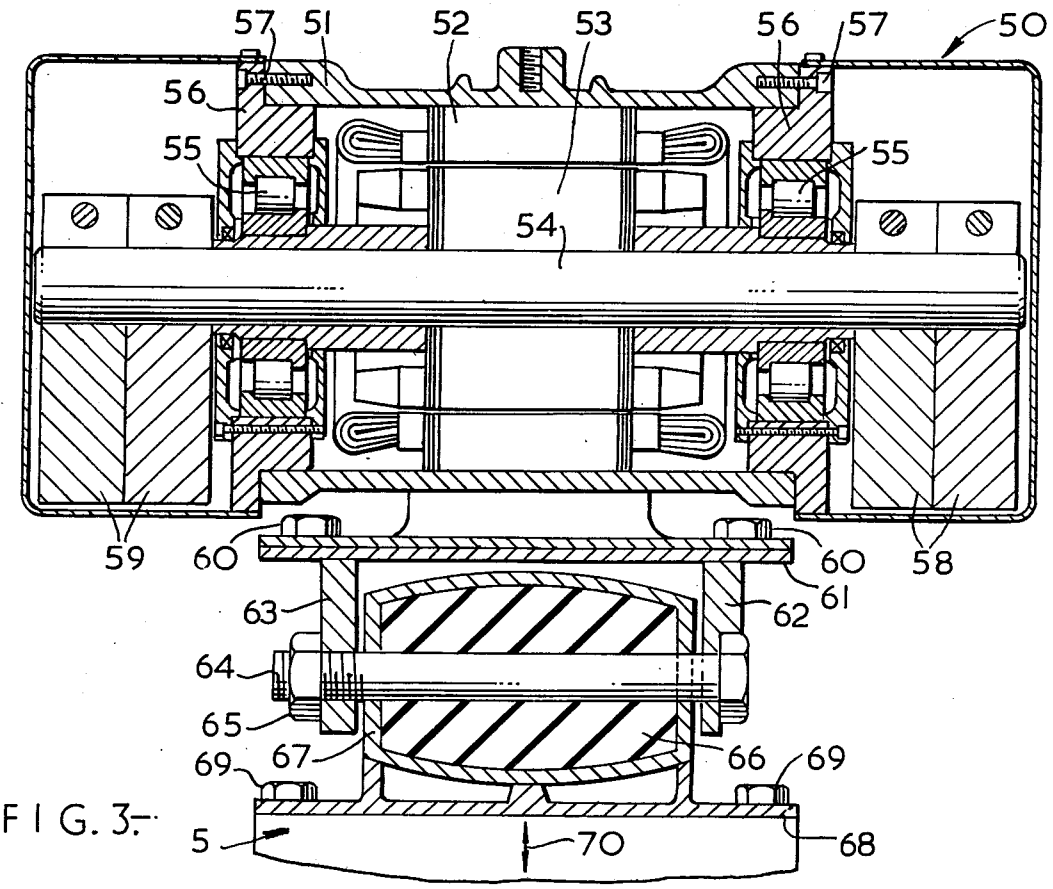
FIG. 3 is a cross-section on the line III-III of FIG. 1.

The apparatus comprises a base 1 having anti-vibration support pads 2 on the lower surface thereof. Secured to each side of the base are a series of springs 3 which may be of steel or other material or may be laminations of wood, plastics or other materials. The other ends of the springs are secured to a seive carrier 4. A rotational vibratory motor 50 is mounted by a resilient mounting on a plate 5 secured to the sieve carrier. The rotational vibratory motor 50 is a squirrel-cage electric motor having a frame 51 in which is mounted a stator 52. A rotor 53 is arranged within the stator and is secured to a shaft 54 supported by roller bearings 55, mounted in housings 56 secured to the frame 51 by bolts 57. At each end the shaft carries a series of out-of-balance weights 58, 59 which are adjustable in known fashion to give the required centrifugal force output. The frame 51 of the motor is secured by bolts 60 to a pendulum mounting base which comprises a mounting plate 61 from which depend two lugs 62 and 63 held on a shaft 64 by a nut 65. The shaft 64 is bonded to a mass 66 of solid rubber, which is also bonded to a casing 67 mounted on a further base plate 68, and the base plate 68 is secured by bolts 69 to the mounting plate 5 on the sieve carrier. When the motor is run the shaft 54 rotates and the out-of-balance weights give rise to a vibratory motion in a plane perpendicular to the shaft 54. The vibrations perpendicular to the plane of the paper as seen in FIG. 3 are absorbed by the solid rubber, which acts as a resilient damping medium, with the result that only vibrations in the direction indicated by the arrow 70 are transmitted to the mounting plate 5. The vibrations transmitted to the sieve carrier 4 are therefore substantially wholly horizontal, although a negligible vertical movement of the sieve carrier does occur due to the presence of the inclined springs 3.

The sieve carrier comprises two side plates 6 and 7 with upwardly turned flanges 8 and 9 at their upper ends and two ends plates 10 and 11 with upwardly turned flanges 12 and 13 at their upper ends. The base plate 14 extends between the side plates and a reinforcing channel section member 15 is secured to the two side plates beneath the base plate. The elements of the sieve carrier are welded together and in addition the reinforcing section 15 is secured to the base plate 14 by bolts 16. A feed plate 17 is welded between the side plates 6 and 7 at one end of the sieve carrier and leads to a discharge outlet 18 from the end plate 10. A further discharge outlet 19 opens from the base plate 14.

Welded to the side plates 6 and 7 of the sieve carrier are two longitudinally extending angle brackets 20 and 21. Two further oppositely directed angle brackets 22 and 23 are positioned above brackets 20 and 21 and are secured to the side plates 6 and 7 by bolts 24 and 25 and nuts on the bolts. The bolts pass through vertically elongated holes in the side walls 6 and 7. Strips 26 to 29 of resilient rubber are bonded to the angle brackets 20 to 23 respectively. Each strip is of substantially L-shaped cross-section and the strips support a sieve frame shown generally as 30. The sieve frame is composed of two longitudinal members 31 and 32 which are clamped respectively between the strips 26 and 28 and the strips 27 and 29. The frame also has transverse members 33 and 34. The member 33 bears on resilient rubber strips 35 and 36 secured to the feed plate 17. Frame members 31 to 34 support the actual sieving medium 37, and the arrangement is such that the sieving medium is inclined at no more than 5° to the horizontal.

The frame member 34 is welded to a coupling boss 38 which is connected to the output member 39 of an ultrasonic transducer 40 by way of coupling stud 41 and copper washer 42. The end of the coupling boss passes through a hole in the end plate 11 of the sieve carrier and through a sheet 43 of resilient rubber extending the full width of the end wall 11. The transducer 40 is mounted on the channel section 4 and leads 44 are taken from the transducer to a control box. The transducer and the coupling means are aligned so that the output vibrations from the transducer are applied to the sieve frame in a direction substantially parallel to the plane of the sieving medium.

Mounted above the sieve carrier is a hopper 45 having an adjustable outlet gate 46. A vibrator 47 is secured to the hopper and this vibrator may, for example, be an air pulser, an electromagnetic vibrator or an ultrasonic generator. Hoppers having adjustable feed gaps and vibrators are conventional.

To use the apparatus suitable sieving medium is secured to the sieve frame, the material and mesh size of the sieving material being chosen according to the material to be sieved. The sieving medium may be in conventional cloth, plastics, woven wire or other metallic sieving medium. The sieve carrier is vibrated by running the motor 50. The ultrasonic transducer 40 is started and material is fed from the hopper 45 on to the sieving medium. It will be appreciated that the sieving medium receives vibrations both from the ultrasonic generator and from the vibrator motor 50, and that both sets of vibrations are substantially in the plane of the sieving medium. The rate of feed of material from the hopper and the amplitude of the ultrasonic output are adjusted until material is being fed on to the sieving medium at the same rate as material (both undersize and oversize) leaves this medium. The undersize material falls through the sieving medium and collects on the base plate 14 of the sieve carrier along which it is transported by virtue of vibratory motion to fall through the discharge outlet 19 for collection. The oversize material travels over the upper surface of the sieving medium to the end plate 17 and thence to the discharge outlet 18. As there is virtually no movement of the sieving medium transverse to its own plane the material being sieved travels in contact with the sieving medium and does not become airborne, so ensuring that virtually none of the undersized material travels over the full length of the sieving medium to the end plate 17.

A suitable adjustment of feed rate and ultrasonic amplitude for any given material and sieving medium may be obtained simply from visual observation of the material. The conditions are adjusted so that the material travels in a steady progression over the sieving medium, without any build-up of material at any part of the sieve.

Figure 4:
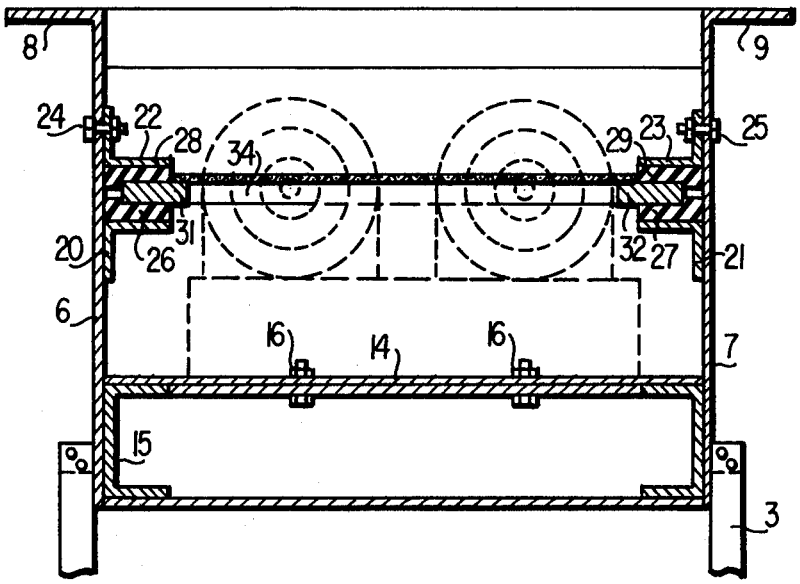
FIG. 4 is a cross section similar to FIG. 2 but illustrating two rather than one ultrasonic generators.

To illustrate the efficiency of the method of the invention this has been used to sieve gum acacia of average particle size 40 microns through a 200 mesh (British Standard) sieve, i.e., having a mesh opening of 75 microns. Gum acacia is recognised as being a material which is very difficult to sieve. A sieve area of 6 square feet was used with two ultrasonic generators **40*a* and 40*b*, one at each side of the sieve as shown in FIG. 4**, each generator operating at 150 watts at a frequency of 25 kilohertz. The sieve angle of inclination to the horizontal was 3°. The gum acacia was fed onto the seiving medium at a rate of 250 kg/hr., 90% of the material fell through the sieving medium and 10% rolled over the sieving medium. There was no clogging of the sieve and the sieving efficiency was 100%, as shown by an analysis of the material that rolled over. This matrial was found to be completely clear of particles having a size of 40 microns or less.

What I claim is:

1. Sieving apparatus comprising a sieve carrier, means for imparting longitudinal vibratory movement to the sieve carrier said movement having substantially no vertical component, a sieving medium, a sieve frame to which said sieving medium is secured and supporting said sieving medium at an inclination of not more than 5° to the horizontal, resilient means interposed between the sieve frame and the sieve carrier to support said sieve frame in said sieve carrier, an ultrasonic generator mounted on said sieve carrier and separate from said means for imparting vibratory motion, and coupling means coupling the output from said ultrasonic generator to said sieve frame, in a direction substantially parallel to the plane of the sieving medium.

2. Sieving apparatus according to claim 1 in which the means for imparting vibratory motion to the sieve carrier is a vibrator motor comprising a shaft having an out-of-balance weight, the motor being coupled to the sieve carrier by way of a pendulum base arranged to transmit vibrations to the sieve carrier only in a direction substantially parallel to the plane of the sieving medium.

3. Sieving apparatus according to claim 2 in which the sieve frame is wholly supported on the sieve carrier by the resilient means.

4. Sieving apparatus according to claim 3 in which the resilient means are strips of resilient material interposed between the sieve frame and the sieve carrier.

5. Sieving apparatus according to claim 4 in which the resilient material is rubber.

6. Sieving apparatus according to claim 4 in which the sieve frame comprises longitudinal and transverse members, and the longitudinal members are clamped between opposed angle girders extending longitudinally along side walls of the sieve carrier, strips of the resilient material being located between each angle girder and longitudinal member.

7. Sieving apparatus according to claim 2 in which the ultrasonic generator is tunable.

8. Sieving apparatus according to claim 2 in which more than one ultrasonic generaor is applied to the sieve frame.

9. Sieving apparatus according to claim 2 in which the ultrasonic generator is coupled directly to the sieve frame by a substantially rigid coupling.

* * * * *